US008078069B2

(12) United States Patent
Otsuka et al.

(10) Patent No.: US 8,078,069 B2
(45) Date of Patent: Dec. 13, 2011

(54) IMAGE FORMING APPARATUS AND IMAGE FORMING METHOD

(75) Inventors: Masayuki Otsuka, Nara (JP); Katsuhiro Nagayama, Nara (JP); Takashi Kitagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 640 days.

(21) Appl. No.: 12/217,234

(22) Filed: Jul. 2, 2008

(65) Prior Publication Data

US 2009/0010670 A1 Jan. 8, 2009

(30) Foreign Application Priority Data

Jul. 4, 2007 (JP) ..... 2007-176648

(51) Int. Cl.
*G03G 15/00* (2006.01)

(52) U.S. Cl. ..... 399/49; 399/58; 399/60; 399/72; 399/75

(58) Field of Classification Search ..... 399/75, 399/9–10, 31, 36, 49, 58, 60, 72
See application file for complete search history.

(56) References Cited

U.S. PATENT DOCUMENTS

| | | | | |
|---|---|---|---|---|
| 6,167,217 | A * | 12/2000 | Kelsch et al. | 399/72 |
| 6,215,968 | B1 | 4/2001 | Uehara et al. | |
| 6,327,453 | B1 * | 12/2001 | Imaizumi et al. | 399/301 |
| 6,381,435 | B2 * | 4/2002 | Shinohara et al. | 399/301 |
| 7,162,171 | B2 * | 1/2007 | Sugiyama | 399/49 |
| 7,310,483 | B2 * | 12/2007 | Mizuno | 399/39 |
| 7,333,740 | B2 * | 2/2008 | Sakamoto et al. | 399/49 |
| 7,457,556 | B2 * | 11/2008 | Sekiguchi et al. | 399/53 |
| 7,639,958 | B2 * | 12/2009 | Okamoto et al. | 399/38 |
| 7,664,412 | B2 * | 2/2010 | Taguchi et al. | 399/49 |
| 7,860,413 | B2 * | 12/2010 | Hayashi | 399/28 |
| 7,978,995 | B2 * | 7/2011 | Isobe et al. | 399/70 |
| 2002/0118976 | A1 * | 8/2002 | Fischer | 399/49 |
| 2004/0091292 | A1 * | 5/2004 | Itoh et al. | 399/299 |
| 2005/0191068 | A1 | 9/2005 | Sato | |
| 2005/0248801 | A1 * | 11/2005 | Miyahara et al. | 358/1.14 |
| 2005/0281573 | A1 * | 12/2005 | Kitagawa et al. | 399/49 |
| 2006/0002727 | A1 * | 1/2006 | Kanzaki | 399/49 |
| 2006/0214973 | A1 * | 9/2006 | Iannazzi | 347/16 |
| 2008/0075484 | A1 * | 3/2008 | Komiya | 399/39 |
| 2008/0089706 | A1 * | 4/2008 | Nakazato et al. | 399/44 |
| 2008/0174834 | A1 * | 7/2008 | Ueda et al. | 358/488 |

FOREIGN PATENT DOCUMENTS

| | | |
|---|---|---|
| JP | 07-020669 | 1/1995 |
| JP | 2001-013748 | 1/2001 |
| JP | 2001-013753 | 1/2001 |
| JP | 2005-221760 | 8/2005 |
| JP | 2005-249873 | 9/2005 |

* cited by examiner

*Primary Examiner* — David Gray
*Assistant Examiner* — Geoffrey Evans
(74) *Attorney, Agent, or Firm* — Edwards Wildman Palmer LLP; David G. Conlin; Catherine J. Toppin

(57) ABSTRACT

It is judged whether a sufficient time for executing all of three correction processings (a high density correction processing, a halftone correction processing, and a registration correction processing) can be secured or not. When the sufficient time cannot be secured, the high density correction processing as an essential correction processing is executed. A history of the halftone correction processing and a history of the registration correction processing are compared with each other. A date of latest execution of the halftone correction processing and a date of latest execution of the registration correction processing are compared with each other to judge whether or not the execution of the halftone correction processing is earlier, and the registration correction processing and the halftone correction processing are executed, respectively.

7 Claims, 4 Drawing Sheets

IMAGE FORMING APPARATUS AND IMAGE FORMING METHOD

CROSS-REFERENCE TO RELATED APPLICATION

This application claims priority to Japanese Patent Application No. 2007-176648, which was filed on Jul. 4, 2007, the contents of which are incorporated herein by reference in its entirety.

BACKGROUND OF THE INVENTION

1. Field of the Invention

The invention relates to an image forming apparatus, and an image forming method, for forming images using electrophotography.

2. Description of the Related Art

An image forming apparatus using electrophotography (hereinafter often simply referred to as image forming apparatus) is at present widely used in various fields due to its capability of printing a high quality image on a recording medium with a simple operation. The image forming apparatus includes a photoreceptor drum, a charging section, an exposing section, a developing section, a transferring section, and a fixing section. The photoreceptor drum has a photosensitive layer on its surface. The charging section charges the photoreceptor drum surface to predetermined polarity and potential. The exposing section forms an electrostatic latent image on the photoreceptor drum surface that is in the charged state. The developing section supplies a toner to the electrostatic latent image on the photoreceptor drum surface to form a toner image. The transferring section transfers the toner image formed on the photoreceptor drum surface onto a recording medium. The fixing section fixes the toner image onto the recording medium. An image corresponding to image information is formed on the recording medium by the above-described processings by the sections.

In the image forming apparatus, control of toner density in the toner image, which is called process control, is executed in order to obtained a high quality image.

The process control includes a high density correction processing for setting of black solid image density, an halftone correction processing for setting of halftone level density, and a registration correction processing for setting of transfer position displacement.

In the process control, a plurality of toner patches (toner images) wherein toner densities are continuously varied by, for example, continuously changing a development bias voltage are firstly formed on the photoreceptor drum surface. The toner densities of the toner patches are detected by a toner density detection section, and the detection result is inputted to a control unit provided in the image forming apparatus. The control unit compares the detection result and a reference toner density that has previously been inputted to judge the toner patch having the toner density that is closest to the reference toner density, and specifies a development bias voltage value to be used for forming the toner patch. By forming a toner image on the photoreceptor drum surface based on the specified development bias voltage value, toner images having densities similar to the reference toner density are stably formed. In the process control, it is possible to adjust the toner densities by changing a charging voltage, an exposure potential, and the like of the photoreceptor drum without limitation to the development bias voltage.

As described above, the process control is a very important control for stabilizing toner densities, i.e. image quality of outputted image.

It is in general possible to obtain high image quality outputs by performing image quality adjustment at a frequent cycle due to prevention of deviation from the reference toner image, but the adjustment consumes time. Further, since deterioration of a developer is promoted by the patch creation due to the above-described patch creation for the adjustment, frequent adjustment is not preferable.

An image forming apparatus disclosed in Japanese Unexamined Patent Publication JP-A 2005-249873 has a judgment section judging, when power is turned on, whether or not image stabilizing processing is required for each of color modes.

As described in the foregoing, since a considerable time is required when the image quality adjustment is frequently executed, a situation of not capable of printing occur when printing is needed to incur inconvenience to a user wanting to output urgently.

An image forming apparatus disclosed in JP-A 2005-249873 simply judges whether or not the image stabilizing processing (image quality adjustment) is required, and many processings are executed in the end in a case where it is judged that the image stabilizing processing is required. Also, image stabilizing processing other than that executed when turning on the power is not considered at all.

SUMMARY OF THE INVENTION

An object of the invention is to provide an image forming apparatus and an image forming method which make it possible to reduce a time required for correction processing and to ensure a minimum image quality.

The invention provides an image forming apparatus forming an image using electrophotography, comprising:

- an image forming section having a photoreceptor having on its surface a photosensitive film for forming an electrostatic latent image and a developing section for forming a toner image by supplying a toner onto the electrostatic latent image on the photoreceptor surface;
- a correcting section executing a plurality of correction processings for performing image quality adjustment of an outputted image of the image forming section;
- a history storage section for storing a history of execution of the plurality of correction processings; and
- a selection section selecting the correction processing to be executed from the plurality of the correction processings based on the history.

According to the invention, in a case where the correcting section executes a plurality of correction processings in order to perform image quality adjustment of an outputted image of the image forming section, the selection section selects a correction processing to be executed from among the plurality of correction processings based on the history of execution.

In the image forming apparatus, only the selected correction processing is executed and a time required for executing the selected correction processing is less than that required for executing all the correction processings, so that in a case where a sufficient time for the correction processings cannot be secured, it is possible to reduce a time required for executing the correction processing and ensure a minimum image quality.

In the invention, it is preferable that the plurality of correction processings comprises a high density correction processing as an essential processing, a halftone correction processing and a registration correction processing as an optional processing, and the selection section refers to a history of the halftone correction processing and the registration correction processing and selects from the halftone correction processing and the registration correction processing either one whose latest execution is earlier than that of the other.

According to the invention, since the halftone correction processing and the registration correction processing are each time-consuming as compared to the high density correction processing, it is possible to reduce a time required for the correction processing by executing either one of the halftone correction processing and registration correction processing. Also, it is possible to always ensure uniform image quality because it can be avoided that only either one of the halftone correction processing and the registration correction processing is executed frequently and the other is not executed at all. In view of the fact that the halftone correction processing and the registration correction processing require the formation of plurality of toner patches, the selection of either one of the correction processings contributes to a reduction in number of patches to be formed and suppression of deterioration of the developer.

In the invention, it is preferable that the high density correction processing is executed at a toner density as is about 1.35 measured by a Macbeth density meter.

According to the invention, it is possible to execute the correction processing at the sufficient density by executing the high density correction processing at a toner density as is about 1.35 measured by a Macbeth density meter.

In the invention, it is preferable that the selection section informs, in a case of selecting both of the halftone correction processing and the registration correction processing, that both of the halftone correction processing and the registration correction processing are to be executed.

According to the invention, it is possible to inform the user that a certain time is required for outputting due to the execution of both the halftone correction processing and the registration correction processing.

In the invention, it is preferable that the image quality adjustment is executed when the apparatus is started up, when the cumulative number of printed copies reaches to a predetermined value, or when a toner consumption amount by a pixel count reaches to a predetermined value.

According to the invention, since the image quality deterioration depends much on a toner consumption amount and deterioration of a developer, it is possible to perform more accurate image quality adjustment by performing the adjustment at the above-described timing.

In the invention, it is preferable that the image forming apparatus is a tandem color image forming apparatus.

According to the invention, since a time required for correction processing is relatively long in the case of the tandem color image forming apparatus, it is possible to more prominently exhibit the time reducing effect.

The invention provides an image forming method of forming an image using electrophotography, comprising:

storing a history of execution of a plurality of correction processings for performing image quality adjustment of an outputted image of an image forming section comprising a developing section for forming a toner image by supplying a toner to an electrostatic latent image on a photoreceptor surface, the image quality adjustment of the outputted image being caused by the plurality of correction processings, and selecting the correction processing to be executed from the plurality of correction processings based on the history.

According to the invention, a history of execution of a plurality of correction processings is stored for performing image quality adjustment of an outputted image of an image forming section comprising a developing section for forming a toner image by supplying a toner to an electrostatic latent image on a photoreceptor surface, and the correction processing to be executed is selected from the plurality of correction processings based on the history.

Only the selected correction processing is executed and a time required for executing the selected correction processing is less than that required for executing all the correction processings, so that in a case where a sufficient time for the correction processings cannot be secured, it is possible to reduce a time required for executing the correction processing and ensure a minimum image quality.

The invention provides a computer-readable recording medium on which an image processing program for causing a computer to execute the image forming method is recorded.

According to the invention, it is possible to provide a computer-readable recording medium on which an image processing program for causing a computer to execute the image forming method is recorded.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
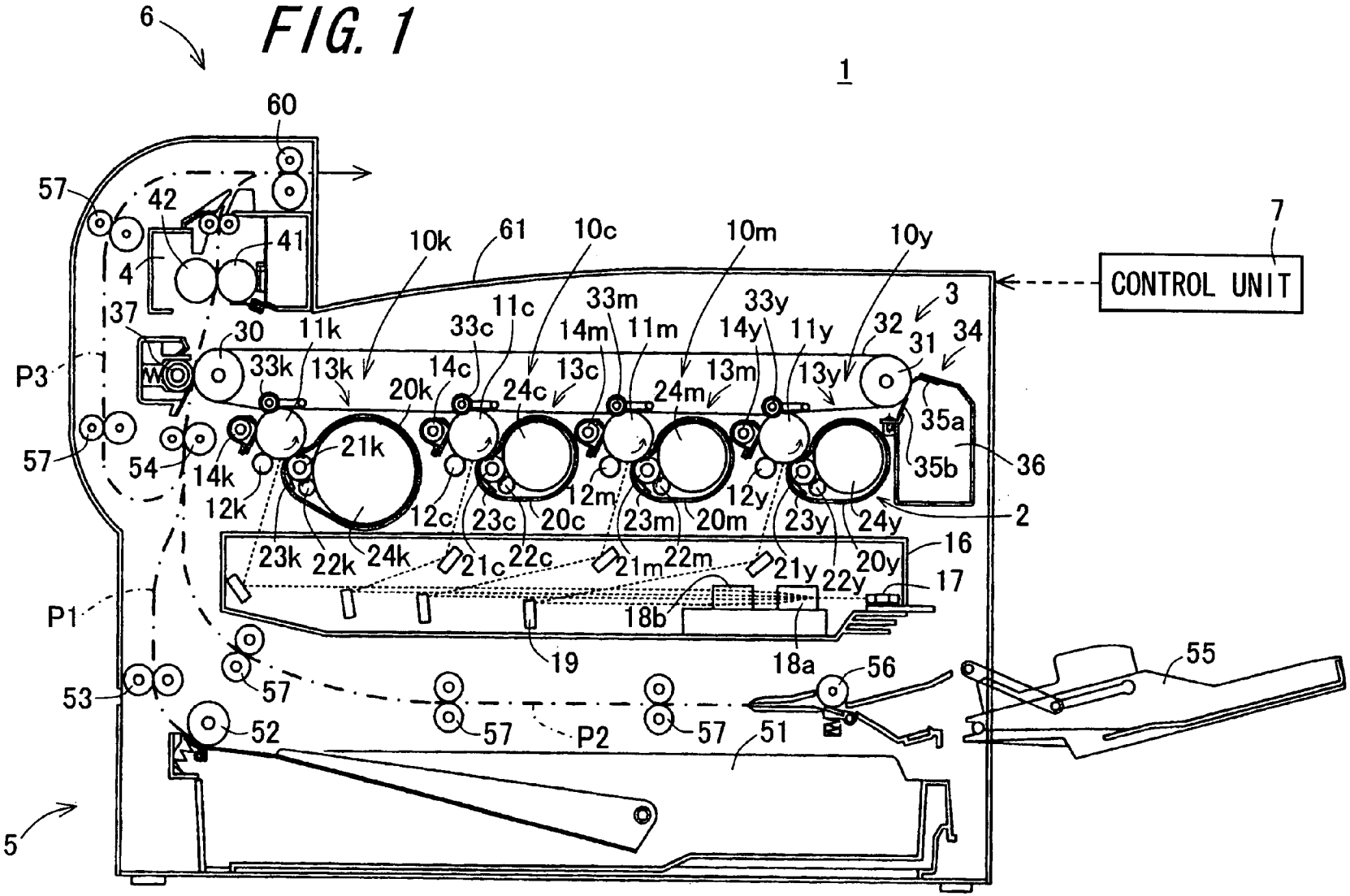
FIG. 1 is a sectional view schematically showing a structure of an image forming apparatus according to one embodiment of the invention.

Now referring to the drawings, preferred embodiments of the invention are described below.

Figure 2:
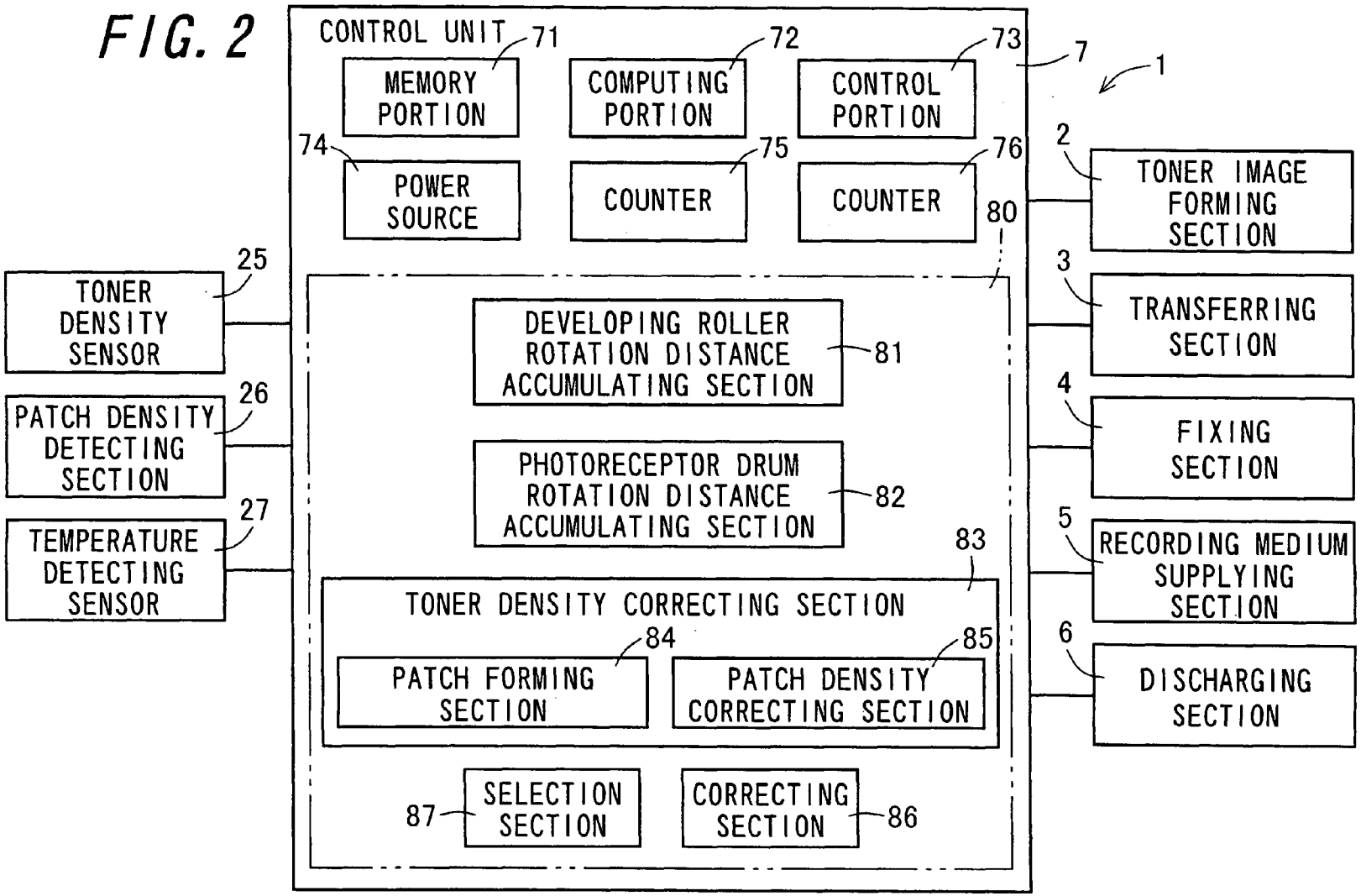
FIG. 2 is a schematic block diagram of the electrical constitution of the image forming apparatus.

FIG. 1 is a sectional view schematically showing a structure of an image forming apparatus 1 according to one embodiment of the invention. FIG. 2 is a schematic block diagram of the electrical constitution of the image forming apparatus 1. The image forming apparatus 1 is a multifunctional printer having a printer function and a facsimile function in combination and forms a full color image or a monochrome image on a recording medium in response to image information transmitted thereto. That is, in the image forming apparatus 1, there are two types of printing modes of a printer mode and a facsimile mode, and the printer mode or the facsimile mode is selected by a control unit 7 in accordance with operation input from an operation section (not shown), or reception of a print job from a personal computer, a potable terminal apparatus, an information storage medium, or external appliances using a memory apparatus.

In the image forming apparatus 1, three types of print modes, namely, a monochrome image print mode, a color image print mode, and a thick paper print mode, are set. In the monochrome image print mode, a monochrome (single color) image is printed at a monochrome image print speed. The monochrome image print speed is the most highest among the three types of print modes. In the color image print mode, a color image is printed at a color image print speed. The color image print speed is higher than the print speed in the thick paper print mode. In the thick paper print mode, an image is printed on a thick paper at a thick paper print speed. The thick paper means a recording paper having a basis weight of 106 to 300 g/m$^2$. In the thick paper print mode, it is also possible to give settings by manual input via an operation panel (not shown) provided at a vertically upper portion of the image forming apparatus. In this embodiment: a process speed and a print speed in the monochrome image forming mode (high speed print mode) are 255 mm/sec and 45 sheets/min; a process speed and a print speed in the color image forming mode (middle speed print mode) are 167 mm/sec and 35 sheets/min; and a process speed and a print speed in the thick paper print mode (low speed print mode) are 83.5 mm/sec and 17.5 sheets/min.

The image forming apparatus 1 is a tandem color image forming apparatus and includes a toner image forming section 2, a transferring section 3, a fixing section 4, a recording medium supplying section 5, a discharging section 6, and a control unit 7. Among these sections, the toner image forming section 2, the transferring section 3, the fixing section 4, the recording medium supplying section 5, and the discharging section 6 correspond to the image forming section. The number of each of members constituting the toner image forming section 2 and a part of members included in the transferring section 3 is four in order to deal with image information of colors of black (k), cyan (c), magenta (m), and yellow (y). Each of the four members corresponding to the colors are distinguished by adding an alphabet representing the color to the reference numeral, and, when the four members are collectively referred to, the four members are indicated only by the reference numeral.

The toner image forming section 2 includes a photoreceptor drum 11, a charging section 12, an exposing section 16, a developing section 13, and a cleaning unit 14. The charging section 12, the developing section 13, and the cleaning unit 14 are disposed around the photoreceptor drum 11 in this order from an upstream side in a rotation direction of the photoreceptor drum 11.

The photoreceptor drum 11 is a roller-like member that is supported as being capable of rotating about an axis thereof by a driving section (not shown) and has on its surface a photosensitive film on which an electrostatic latent image, i.e. a toner image, is to be formed. For the photoreceptor drum 11, it is possible to use a roller-like member including a conductive substrate (not shown) and a photosensitive layer (not shown) formed on a surface of the conductive substrate. It is possible to use a cylindrical, columnar, sheet-like or the like conductive substrate as the conductive substrate, and the cylindrical conductive substrate is most preferred. Examples of the photosensitive layer include an organic photosensitive layer, and an inorganic photosensitive layer. Examples of the organic photosensitive layer includes a laminate of a charge generating layer that is a resin layer containing a charge generating substance and a charge transporting layer that is a resin layer containing a charge transporting substance; and a resin layer containing therein a charge generating substance and a charge transporting substance. Examples of the inorganic photosensitive layer include a layer containing one or two selected from zinc oxide, selenium, and amorphous silicon. An undercoat layer may be formed between the conductive substrate and the photosensitive layer, and a surface layer (protection layer) for mainly protecting the photosensitive layer may be provided on a surface of the photosensitive layer.

The charging section 12 is a roller-like member so provided as to be in pressure-contact with the photoreceptor drum 11. A power source (not shown) is connected to the charging section 12 to apply a voltage to the charging section 12. Upon reception of the voltage from the power source, the charging section 12 charges the surface of the photoreceptor drum 11 to predetermined polarity and potential. Though the roller-like charging section is used in this embodiment, it is possible to use a contact type charging device such as a charge brush type charging device, a charger type charging device, a sawtooth type charging device, an ion generation device, and a magnetic brush without particular limitation to the roller-like charging section.

As the exposing unit 16, a laser scanning unit including an light irradiation section (not shown), a polygon mirror 17, a first Fθ lens 18*a*, a second Fθ lens 18*b*, and a plurality of reflection mirrors 19 is used. The exposing unit 16 irradiates the surface of the photoreceptor drum 11 being in the charged state with signal light to form an electrostatic latent image corresponding to image information. The light irradiation section emits the signal light corresponding to the image information. As the light irradiation section, a light source such as a semiconductor laser and an LED array may be used, for example. A liquid crystal shutter may be used in combination with the light source. The polygon mirror 17 deflects the signal light emitted from the light irradiation unit by an equiangular speed rotation. The first Fθ lens 18*a* and the second Fθ lens 18*b* separate the signal light deflected by the polygon mirror 17 into signal light corresponding to image information of yellow, magenta, cyan, and black and emits the signal light to reflection mirrors 19 corresponding to the colors. The reflection mirrors 19 reflect the signal light of the colors emitted via the first Fθ lens 18*a* and the second Fθ lens 18*b* toward the photoreceptor drums 11 corresponding to the colors. Thus, an electrostatic latent image corresponding to each of the colors is formed on each of the photoreceptor drums 11*y*, 11*m*, 11*c*, and 11*b*.

The developing unit 13 includes a developing tank 20, a developing roller 21, a supplying roller 22, a layer thickness regulation member 23, a toner cartridge 24, and a toner density sensor 25 (see FIG. 2).

The developing tank 20 is a container-like member that is so disposed as to face the surface of the photoreceptor drum 11 and houses in its inner space the developing roller 21, the supplying roller 22, the layer thickness regulation member 23, and the toner cartridge 24 as well as a developer. As the developer, a single component developer including a toner or a two-component developer containing a toner and a carrier may be used. An opening is formed on a lateral surface of the developing tank 20 facing to the photoreceptor drum 11, and the surface of the photoreceptor drum 11 and the developing roller 21 are opposed to each other via the opening.

The developing roller 21 is a roller-like member that is rotatably supported by the developing tank 20 and capable of rotating about an axis thereof by a driving section (not shown) and. The developing roller 21 is provided in such a fashion that its axis is in parallel to the axis of the photoreceptor drum 11. The developing roller 21 bears a developer layer on its surface and supplies the toner to the electrostatic latent image on the surface of the photoreceptor drum 11 at a pressure-contact portion (developing nip portion) with the photoreceptor drum 11 to form the toner image by developing the electrostatic latent image. The power source (not shown) is connected to the developing roller 21, so that at the time of supplying the toner a potential that is reverse to a charged potential of the toner is applied to a surface of the developing roller 21 as a developing bias voltage (hereinafter simply referred to as developing bias) from the power source. Thus, the toner on the surface of the developing roller 21 is smoothly supplied to the electrostatic latent image. Further, it is possible to control an amount (toner deposition amount) of the toner supplied to the electrostatic latent image by changing a value of the developing bias.

The supplying roller 22 is a roller-like member that is rotatably supported by the developing tank 20 and capable of rotating about an axis thereof by a driving section (not shown). The supplying roller 22 is provided to be opposed to photoreceptor drum 11 via the developing roller 21. The supplying roller 22 supplies the developer inside the developing tank 20 to the surface of the developing roller 21 by the rotational driving and mixes the toner discharged from the toner cartridge 24 described later in this specification with the developer inside the developing tank 20. The layer thickness regulation member 23 is a plate-like member disposed in such a fashion that one end thereof is supported by the developing tank 20 and the other end is abutted to the surface of the developing roller 21. The layer thickness regulation member 23 regulates a thickness of a developer layer on the surface of the developing roller 21.

The toner cartridge 24 is a cylindrical container-like member that is provided detachable from a main body of the image forming apparatus 1 and stores a toner in its inner space. The toner cartridge 24 is so provided as to be capable of rotating about an axis thereof by a driving section provided inside the image forming apparatus 1. A toner discharging port (not shown) extending in an axial direction is formed on an axially lateral surface of the toner cartridge 24, and the toner is discharged to the developing tank 20 from the toner discharging port along with rotation of the toner cartridge 24. An amount of toner to be discharged from the toner cartridge 24 by one rotation of the toner cartridge 24 is substantially constant. Therefore, it is possible to control a replenishing amount of the toner to the developing tank 20 by controlling the number of rotations of the toner cartridge 24.

The toner density sensor 25 is attached to a developing tank bottom surface that is vertically below the supplying roller 22 and disposed in such a fashion that a sensor surface is exposed to an inside of the developing tank 20. The toner density sensor 25 is electrically connected to the control unit 7.

A toner density sensor 25 is provided for each of the toner image forming sections 2*y*, 2*m*, 2*c* and 2*k*. The control unit 7 makes such a control as to supply the toner to the inside of each of the developing tanks 20*y*, 20*m*, 20*c*, and 20*k* by rotatably driving each of the toner cartridges 24*y*, 24*m*, 24*c*, and 24*k* in response to a detection result of the toner density sensor. As the toner density sensor 25, ordinary toner density sensors are usable, and examples thereof include a transmitted light detection sensor, a reflected light detection sensor, and a permeability detection sensor. Among these detection sensors, the permeability detection sensor is preferred.

Application of a control voltage to the magnetic permeability detection sensor is controlled by the control unit 7.

The permeability detection sensor of this type is commercially available, and examples thereof include TS-L, TS-A, and TS-K (trade names, all manufactured by TDK Corporation).

The cleaning unit 14 removes the toner remaining on the surface of the photoreceptor drum 11 after the transfer of the toner image onto an intermediate belt 32 described later in this specification to clean the surface of the photoreceptor drum 11. As the cleaning unit 14, those including a cleaning blade, a first waste toner storage tank, and a waste toner convey roller may be used, for example. The cleaning blade is a plate-like member for scraping off the toner and the like remaining on the surface of the photoreceptor drum 11. One end of the cleaning blade in a width direction abuts on the surface of the photoreceptor drum 11 and the other end thereof is supported by the first waste toner storage tank. The first waste toner storage tank is a container-like member that houses the cleaning blade and the waste toner conveying roller in its inner space and temporarily stores the toner and the like scraped off by the cleaning blade. The waste toner conveying roller is a roller-like member that is rotatably supported by the waste toner storage tank and capable of rotating about an axis thereof by a driving section (not shown). By the rotational driving of the waste toner conveying roller, the toner inside the waste toner storage tank is conveyed to a waste toner storage tank (not shown) via a toner conveying piping (not shown) connected to the first waste toner storage tank to be stored in the waste toner storage tank. The waste toner storage tank is replaced by a new waste toner storage tank when the waste toner storage tank is filled up with the toner.

In this embodiment, a patch density detection section (see FIG. 2) is provided between a downstream side of the developing section 13 and an upstream side of an intermediate transfer nip portion in the rotation direction of the photoreceptor drum 11. The patch density detection section 26 detects a toner density (patch density) of a toner patch formed on the surface of the photoreceptor drum 11 by a patch forming section described later in this specification. The patch density detection section 26 is electrically connected to the control unit 7 of the image forming apparatus 1 to output the detection result to the control unit 7. The control unit 7 controls the toner density of the toner image formed by a toner image forming section 2 in response to the detection result by the patch density detection section 26. The control is performed by changing the developing bias voltage, for example. In addition, it is possible to control the toner density also by adjusting the charged potential of the photoreceptor drum 11, the exposure potential by the exposing unit 16, or the like. As the patch density detection section 26, an ordinary toner density detection sensor such as a transmitted light detection sensor and a reflected light detection sensor.

According to the toner image forming section 2, the electrostatic latent image is formed by irradiating the surface of the photoreceptor drum 11 in the uniformly charged state by the charging section 12 with the signal light corresponding to the image information from the exposing unit 16; a toner image is formed by supplying the toner from the developing section 13; the toner image is transferred onto the intermediate transfer belt 32; and the toner remaining on the surface of the photoreceptor drum 11 is removed by the cleaning unit 14. The above-described series of toner image forming operations is executed repeatedly.

The transferring section 3 includes a driving roller 30, a driven roller 31, the intermediate transfer belt 32, intermediate transfer rollers 33 (y, m, c, k), a transfer belt cleaning unit 34, and a transfer roller 37, and is disposed above the photoreceptor drum 11.

The driving roller 30 is a roller-like member that is provided rotatably by a supporting section (not shown) and capable of rotating about an axis thereof by a driving section. The driving roller 30 rotates the intermediate transfer belt 32 by the rotational driving. The driving roller 30 is brought into pressure-contact with the transfer roller 37 via the intermediate transfer belt 32. The pressure-contact portion between the driving roller 30 and the transfer roller 37 is the transfer nip portion. The driven roller 31 is a roller-like member that is provided rotatably by a supporting section (not shown). The driven roller 31 is driven to rotate along with the rotation of the intermediate transfer belt 32. The driven roller 31 imparts an appropriate tension to the intermediate transfer belt 32 to assist smooth rotational driving of the intermediate transfer belt 32.

The intermediate transfer belt 32 is an endless belt-like member that forms a movement passage in the form of a loop as being stretched between the driving roller 30 and the driven roller 31 and is rotatably driven by the rotational driving of the driving roller 30. When the intermediate transfer belt 32 passes on the photoreceptor drum 11 by contacting the photoreceptor drum 11, a transfer bias having a potential reverse to that of the charged polarity of the toner on the surface of the photoreceptor drum 11 is applied from the intermediate transfer roller 33 opposed to the photoreceptor drum 11 via the intermediate transfer belt 32, so that the toner image formed on the surface of the photoreceptor drum 11 is transferred onto the intermediate transfer belt 32. In the case of a full color image, the toner images of the different colors formed on the photoreceptor drums 11 are successively transferred onto the intermediate transfer belt 32 and overlaid with one another, thereby forming a full color toner image.

The intermediate transfer roller 33 is a roller-like member that is brought into pressure-contact with the photoreceptor drum 11 via the intermediate transfer belt 32 and capable of rotating about an axis thereof by a driving section (not shown). The power source (not shown) for applying the transfer bias as described above is electrically connected to the intermediate transfer roller 33, and the intermediate transfer roller 33 has a function of transferring the toner image formed on the surface of the photoreceptor drum 11 onto the intermediate transfer belt 32. The pressure-contact portion between the intermediate transfer roller 33 and the photoreceptor drum 11 is the intermediate transfer nip portion.

The transfer belt cleaning unit 34 includes transfer belt cleaning blades 35*a* and 35*b* and a second waste toner storage tank 36. Each of the transfer belt cleaning blades 35*a* and 35*b* is a plate-like member for scraping off the toner, paper dust, and the like remaining on the surface of the intermediate transfer belt 32. One end of each of the transfer belt cleaning blades 35*a* and 35*b* in a width direction abuts on the surface of the intermediate transfer belt 32 and the other end thereof is supported by the second waste toner storage tank 36. Further, the transfer belt cleaning blades 35*a* and 35*b* are disposed so as to be opposed to each other. The second waste toner storage tank 36 temporarily stores the toner, paper dust, and the like scraped off by the transfer belt cleaning blades 35*a* and 35*b*.

The transfer roller 30 is a roller-like member that is brought into pressure-contact with the driving roller 30 via the intermediate transfer belt 32 by a pressure-contact mechanism and capable of rotating about an axis thereof by a driving section (not shown). At a transfer nip portion, the toner image borne on and conveyed by the intermediate transfer belt 32 is transferred onto a recording medium supplied from the recording medium supplying section 5 described later in this specification. The recording medium bearing the toner image thereon is fed to the fixing section 4. By the transferring section 3, the toner image transferred onto the intermediate transfer belt 32 from the photoreceptor drum 11 at an intermediate transfer nip portion is conveyed to the transfer nip portion by the rotational driving of the intermediate transfer belt 32 to be transferred onto the recording medium at the transfer nip portion.

The fixing section 4 is a roller-like member that includes a fixing roller 41 and a pressure roller 42 and is provided at the downstream side in a recording medium conveyance direction. The fixing roller 41 is capable of rotating about an axis thereof by a driving section (not shown) and fixes the toner forming the non-fixed toner image borne on the recording medium by heating and melting the toner. A heating section (not shown) is provided inside the fixing roller 41. The heating section heats the fixing roller 41 so that a surface of the fixing roller 41 becomes a predetermined temperature (heating temperature). As the hating section, an infrared heater, a halogen lamp, or the like may be used, for example. The surface temperature of the fixing roller 41 is maintained to a temperature set when designing the image forming apparatus 1. The surface temperature of the fixing roller 41 is controlled by the control unit 7 of the image forming apparatus 1 and a temperature detection sensor provided in the vicinity of the surface of the fixing roller 41 for detecting the surface temperature of the fixing roller 41, for example. The temperature detection sensor is electrically connected to the control unit 7, and the detection result by the temperature sensor is outputted to the control unit 7. The control unit 7 compares the detection result by the temperature detection sensor with the set temperature, and, in a case where the detection result is lower than the set temperature, sends a control signal to the power source (not shown) that applies a voltage to the heating section, so that the heating by the heating section is promoted to increase the surface temperature.

The pressure roller 42 is so provided as to be in pressure-contact with the fixing roller 41 and so supported as to be rotatably driven by the rotational driving of the pressure roller 42. A pressure-contact portion between the fixing roller 41 and the pressure roller 42 is a fixing nip portion. The pressure roller 42 assists the fixation of the toner image to the recording medium by pressing the toner and the recording medium when the toner melted by the fixing roller 41 is fixed to the recording medium. A heating section such as an infrared heater and a halogen lamp may be provided inside the pressure roller 42. By the fixing section 4, the toner image is fixed to the recording medium to form an image by pressing the toner image against the recording medium with heating when the recording medium on which the toner image has been transferred in the transferring section 3 passes through the fixing nip portion as being held between the fixing roller 41 and the pressure roller 42.

The recording medium supplying section 5 includes a paper feed tray 51, pickup rollers 52 and 56, conveying rollers 53 and 57, registration rollers 54, and a manual paper feed tray 55. The paper feed tray 51 is a container-like member provided at a vertically lower portion of the image forming apparatus 1 for storing the recording mediums. Examples of the recording medium include plain paper, color copy paper, sheets for overhead projector, and a postcard. The size of the recording medium includes A3, A4, B4, B5, and the like. The pickup roller 52 is a roller-like member that picks up the recording mediums stored in the paper feed tray 51 one by one to feed the recording mediums into a paper conveyance path P1. The conveying rollers 53 are a pair of roller-like members so provided as to be in pressure-contact with each other and convey the recording medium toward the registration rollers 54. The registration rollers 54 are a pair of roller-like members so provided as to be in pressure-contact with each other, and feed the recording medium fed from the transfer roller 53 to the transfer nip portion in synchronization with the conveying of the toner image borne on the intermediate transfer belt 32 to the transfer nip portion. The manual paper feed tray 55 is a device storing recording mediums which are different from the recording mediums stored in the paper feed tray 51 and may have any size and which are to be taken into the image forming apparatus 1. The pickup roller 56 is a roller-like member that feeds the recording medium taken into the image forming apparatus 1 from the manual paper feed tray 55 to a paper conveyance path P2. The paper conveyance path P2 is connected to the paper conveyance path P2 at the downstream side in the recording medium conveyance direction. The conveying rollers 57 are a pair of roller-like members so provided as to be in pressure-contact with each other and feed the recording medium taken into the paper conveyance path P2 by the pickup roller 56 to the registration roller 53 via the paper conveyance path P1.

The discharging section 6 includes paper discharging rollers 60, a catch tray 61, and a plurality of conveying rollers 57. The paper discharging rollers 60 are roller-like members so provided as to be in pressure-contact with each other at the downstream side from the fixing nip portion in the paper conveyance direction. The paper discharging rollers 60 are provided as to be capable of foreword and reverse rotation by the driving section (not shown). The paper discharging rollers 60 discharge the recording medium on which the image is formed in the fixing section 4 to the catch tray 61 provided on a vertically upper surface of the image forming apparatus 1. The paper discharging rollers 60 temporarily retain the recording medium discharged from the fixing section 4 and then supplies the recording medium to a paper conveyance path P3 when a print command for both side printing is inputted to the control unit 7 of the image forming apparatus 1. The paper conveyance path P3 is connected to the paper conveyance path P1 at the upstream side of the registration rollers 54 in the recording medium conveyance direction. The plurality of conveying rollers 57 are provided along the paper conveyance path P3 to feed the recording medium that is supplied to the paper conveyance path P3 by the paper discharging rollers 60 after being subjected to one side printing toward the registration rollers 54 on the paper conveyance path P1.

The image forming apparatus 1 includes the control unit 7. The control unit 7 is provided in an upper portion in the inner space of the image forming apparatus 1 and includes a memory portion 71, a computing portion 72, and a control portion 73. To the memory portion 71 of the control unit 7, various values set via the operation panel (not shown) disposed on the upper surface of the image forming apparatus 1, detection results from the sensors (not shown) disposed at the given positions inside the image forming apparatus 1, image information from external devices, data tables for executing various controls, and the like are inputted. Also, programs for executing various functional elements 80 are written in the memory portion 71. As the memory portion 71, those ordinarily used in this filed may be used, and examples thereof include a read only memory (ROM), a random access memory (RAM), and a hard disc drive (HDD). As the external device, electric and electronic appliances that are capable of forming or obtaining image information and electrically connectable to the image forming apparatus may be used, and examples thereof include a computer, a digital camera, a television, a video recorder, a DVD recorder, an HDDVD, a blu-ray disc recorder, a facsimile apparatus, and a portable terminal device. The computing portion 72 fetches various data (image forming command, detection result, image information, etc.) written in the memory portion 71 and the programs of the various functional elements 80 to perform various judgments. The control portion 73 sends a control signal to the apparatus in accordance with the judgment result of the computing portion 72 to perform operation control. The control portion 73 and the computing portion 72 include a processing circuit realized by a microcomputer, microprocessor, or the like provided with a central processing unit (CPU). The control unit 7 includes a main power source 74 together with the processing circuit, and the main power source 74 supplies power not only to the control unit 7 but also to various devices inside the image forming apparatus 1. Here, the various functional elements 80 include a developing roller rotation distance accumulating section 81, a photoreceptor drum rotation distance accumulating section 82, a toner density correcting section 83, a patch forming section 84, a patch density correcting section 85, a correcting section 86, and a selection section 87 described later.

In this embodiment, the reference toner density in the developing tank 20 is written in the memory portion 71 of the control unit 7. The reference toner density is set when designing the image forming apparatus 1. Also, a first data table indicating a relative relationship between a detection result (output voltage value, hereinafter referred to as density detection result) by the toner density sensor 25 at the monochrome image printing speed that is used most frequently in the image forming apparatus 1 and the toner density inside the developing tank 20 has previously been written in the memory portion 71. Specifically, an actual output value (volt) of the magnetic permeability detection sensor for each of the toner density is measured, and a relationship between the toner density and the actual output value of the magnetic permeability detection sensor is obtained. The actual output value is subjected to analog/digital conversion (hereinafter referred to as AD conversion) into 0 to 255 (8 bit). After that, a second data table that is a correction table for converting a density detection result at the color image printing speed into a density detection result at the monochrome image printing speed is previously written in the memory portion 71. Also, a third data table that is a correction table for converting a density detection result at the thick paper printing speed into a density detection result at the monochrome image printing speed is previously written in the memory portion 71. The each of the first to third data tables becomes each data for each color of black (k), magenta (m), cyan (c), and yellow (y). The first to third data tables are also set for each of types of image forming apparatuses and/or each of toner density sensors. The developing roller rotation distance accumulating section 81 accumulates total rotation distances (unit: cm; hereinafter simply referred to as total rotation distance of the developing roller 21) from the start of use of the developing roller 21 (new developing roller) to a present time point. The developing roller rotation distance accumulating section 81 fetches the total rotation number of the developing roller 21 and a running distance (cm) per rotation of the developing roller 21 from the memory portion 71 to obtain the total rotation distance of the developing roller 21 by a calculation for accumulating the distances. The accumulation result by the developing roller rotation distance accumulation section 81 is written in the memory portion 71. The total rotation number of the developing roller 21 is detected by a counter 75 provided inside the control unit 7 for detecting the rotation number of the developing roller 21. The detection result by the counter 75 is written in the memory portion 71. The running distance (cm) per rotation of the developing roller 21 is written in the memory portion 71 in advance.

The photoreceptor drum rotation distance accumulating section 82 has a structure similar to that of the developing roller rotation distance accumulating section 81. The photoreceptor drum rotation distance accumulating section 82 accumulates total rotation distances (unit: cm; hereinafter simply referred to as total rotation distance of the photoreceptor drum 11) from the start of use of the photoreceptor drum 11 (new developing roller) to a present time point. The photoreceptor drum rotation distance accumulating section 82 fetches the total rotation number of the photoreceptor drum 11 and a running distance (cm) per rotation of the photoreceptor drum 11 from the memory portion 71 to obtain the total rotation distance of the photoreceptor drum 11 by a calculation for accumulating the distances. The accumulation result by the photoreceptor drum rotation distance accumulation section 82 is written in the memory portion 71. The total rotation number of the photoreceptor drum 11 is detected by a counter 76 provided inside the control unit 7 for detecting the rotation number of the photoreceptor drum 11. The detection result by the counter 76 is written in the memory portion 71. The running distance (cm) per rotation of the photoreceptor drum 11 is written in the memory portion 71 in advance.

The cumulative number of printed copies is obtained by accumulating the numbers of printed copies until the present time point since the developer was replaced. The number of printed copies may be, for example, the number of pages of inputted image data, the number of read original images, and the number of sheets outputted to the discharging section. In the case of using the number of printed copies as an index for deterioration of the developer, there is a high possibility that the number of printed copies is not suitable as an appropriate index when an amount of a toner used for printing one copy is not considered.

Since it is difficult to measure an actual toner consumption amount, the toner consumption amount is estimated from a gray scale value of pixels, i.e. a pixel count based on image data. Since the actual consumption amount is different from a sum of gray scale values of pixels and fluctuated by the gray scale values of peripheral pixels, it is preferable to create small regions each formed of a plurality of pixels to calculate the consumption amount per small region.

The toner density correcting section 83 corrects the toner density in accordance with the process control. The correction processing is executed by using the patch forming section 84 and the patch density correcting section 85. The patch forming section 84 controls the toner image forming section 2 to form on the surface of the photoreceptor drum 11 toner patches that are toner images for toner density detection. As the toner patches, eight squares each having a side of about 8 cm are formed. The patch forming section 84 forms a plurality of patches in which the toner densities, i.e. the patch densities, are continuously varied by changing forming conditions. Preferably, a plurality of toner patches corresponding to the print densities that can be set in the image forming apparatus 1 are formed. The forming conditions include, for example, a value of the developing bias voltage to be applied to the developing roller 21, a value of the charging voltage (charged potential) applied to the surface of the photoreceptor drum 11, and a value of the charged voltage (exposure potential) of the electrostatic latent image formed on the surface of the photosensitive drum 11 by the exposing unit 16. The plurality of toner patches in which the patch densities are continuously varied are formed by fixing one or more of the above conditions and changing the rest of the conditions by a constant amount as required. For example, the plurality of toner patches may be formed by setting the charged potential and the exposure potential to constant values and changing the developing bias voltage value by a constant amount. The forming conditions of the plurality of toner patches (developing bias voltage value, etc.) are written in the memory portion 71.

The patch density detection section 26 detects the patch densities of the toner patches of the surface of the photoreceptor drum 11. The detection result (hereinafter referred to as patch density detection result) by the patch density detection section 26 is written in the memory portion 71. A reference patch density decided when designing the image forming apparatus 1 has previously been written in the memory portion 71. The reference patch density is written as a reference reflected light amount in the case of a monochrome image or as a scatted light amount in the case of a color image. After the patch density detection by the patch density detection section 26, the toner patches are removed from the surface of the photoreceptor drum 11 by the cleaning unit 14. The control unit 7 fetches the patch density detection result and the reference patch density from the memory portion 71 to compare with each other and reads out the developing bias voltage value used for forming the toner patch having the patch density closest to the reference patch density to detect a difference from the reference developing bias voltage value in the reference patch density, thereby writing the difference in the memory portion 71 as the voltage correction amount.

In the invention, a high density correction processing for setting of black solid image concentration, a halftone correction processing for setting a halftone level density, and a registration correction processing for setting a displacement of a transfer position are executed as image quality adjustment (process control) in the correcting section 86.

Among the correction processings, in the selection section 87, the high density correction processing is used as an essential correction processing, and it is judged whether or not the halftone correction processing and the registration correction processing are to be executed under a certain condition.

As the timing for executing the process control, the process control is executed when there is a high possibility that the state of the apparatus or the state of the developer is changed: when the power is turned on, that is, when the apparatus is started up; when the cumulative number of printed copies reaches to the predetermined value; when printing is not executed for a predetermined period; or when a toner consumption amount by a pixel count reaches to a predetermined value.

Though it is desirable to execute all of the three correction processings as the image quality adjustment, such correction processing requires a long time. Therefore, in a case where a sufficient time for the correction processings cannot be secured, either one of the halftone correction processing and the registration correction processing is executed in order to ensure the minimum image quality.

Hereinafter, the high density correction processing and the halftone correction processing will be briefly described.

The high density correction processing and the halftone density correction processing are executed by detecting patch densities after forming the toner patches as described above.

The high density detection toner patch is formed of a black solid image having a toner density of 1.35 that is detected by a Macbeth density meter.

As the halftone density detection toner patch, a plurality of toner patches each having a pixel matrix of 3×3 and different from each other in density are created. That is, a toner patch is formed by forming a predetermined number of dots using the toner in a certain region in a 3×3 matrix, and then toner patches for a plurality of scales of densities from a low density region to an intermediate density region that is lower in density than the high density region serving as the black solid image by increasing the number of dots. The halftone density correction processing is executed by detecting the patch densities.

The time required for the high density correction processing is about 10 seconds, and the time required for the halftone density correction processing is 40 to 60 seconds.

Hereinafter, the registration correction processing will be described briefly.

Figure 3:
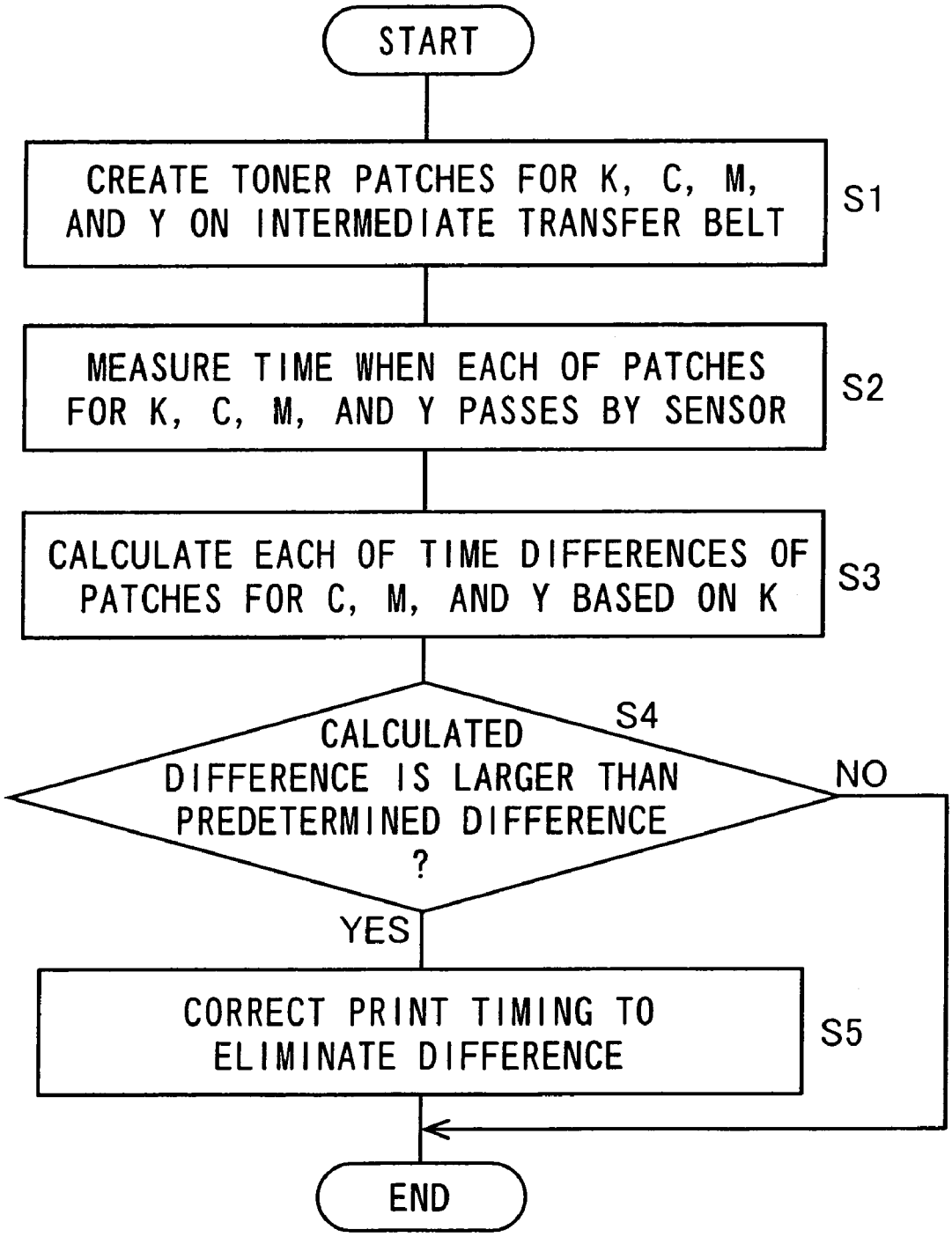
FIG. 3 is a flowchart showing the registration correction processing.

FIG. 3 is a flowchart showing the registration correction processing processing.

Toner patches of the colors C, M, Y, and K are formed on the intermediate transfer belt 32 by the patch forming section 84 (step S1), and a time when each of the patches passes by a reading sensor disposed at a predetermined position is measured (step S2). By using K as the reference, differences between the passing time of the patch K and each of the passing times of the patches of C, M, and Y are calculated (step S3).

The calculated difference and a predetermined difference are compared to each other (step S4), and, since it means that adjustment is necessary in a case where the calculated difference is larger than the predetermined difference, a timing for printing is corrected by the correcting section 86 so that the difference becomes 0 in a case where the calculated difference is larger than the predetermined difference (step S5). When the calculated value is smaller than the predetermined value, the processing is terminated since the correction processing is not necessary in such case.

The time required for the registration correction processing is 30 to 40 seconds.

As described above, the time required for each of the halftone density correction processing and the registration correction processing is longer than that required for the high density correction processing. Therefore, from the halftone correction processing and the registration correction processing either one whose latest execution is earlier than that of the other is executed. Thus, it is possible to shorten the time required for the correction processing, and it is possible to always ensure uniform image quality by avoiding a case wherein one of the correction processings is executed frequently and the other is not executed at all.

In view of the fact that the halftone correction processing and the registration correction processing require the formation of plurality of toner patches, the execution of one of the correction processings contributes to a reduction in number of patches to be formed and suppression of deterioration of the developer.

In order to execute the above correction processing, it is necessary to memorize a history indicating at least when the halftone correction processing and the registration correction processing were executed.

It is preferable that the history may be memorized such that the executed correction processing and the execution date are associated with each other. Only the latest execution date is sufficient, but a history indicating about 10 times of past correction processings may be memorized. As the execution date, it is desirable to memorize not only date but also time of day. As time of day, time of day when the correction processing was terminated is memorized.

Figure 4:
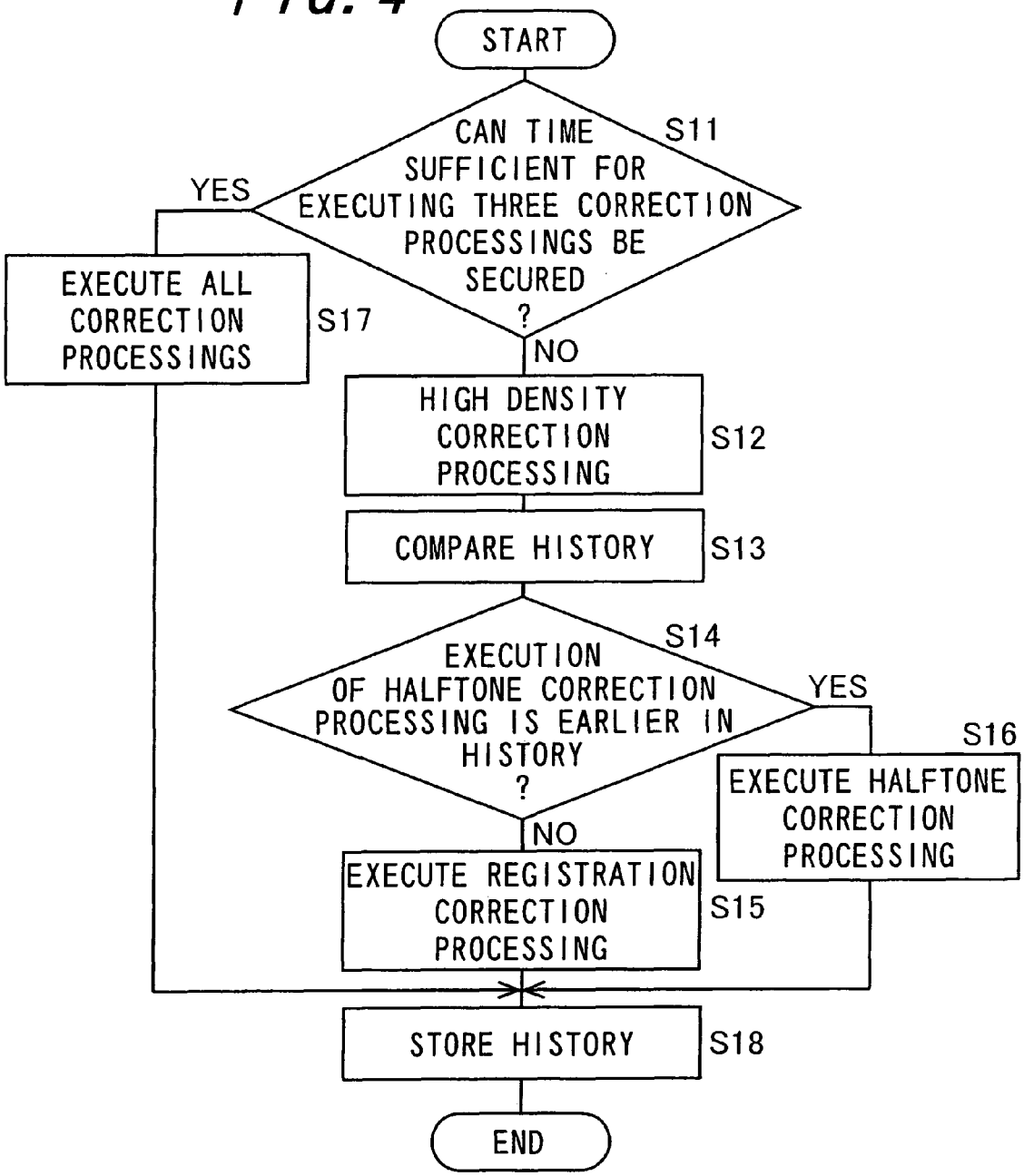
FIG. 4 is a flowchart showing image quality adjustment processing.

FIG. 4 is a flowchart showing image quality adjustment processing.

In step S11, the selection section 87 judges whether a sufficient time for executing all of the three correction processings (high density correction processing, halftone correction processing, and registration correction processing) can be secured or not. For example, when the power is turned on or the like, i.e. in a case where there is an essential processing in addition to the image quality adjustment and the time required for the essential processing is longer than the time required for executing the three correction processings, it is possible to perform the three correction processings. In such case, the process proceeds to step S17, all of the correction processings related to the image quality adjustment are executed.

In a case where the sufficient time cannot be secured, the process proceeds to step S12, the correcting section 86 executes the high density correction processing that is the essential correction processing. In step S13, the selection section 87 compares the history of the halftone correction processing with the history of the registration correction processing. The selection section 87 compares the date of the latest execution of the halftone correction processing with the date of the latest execution of the registration correction processing. In step S14, the selection section 87 judges whether or not the execution of the halftone correction processing is earlier. When the execution of halftone correction processing is earlier in the history, the process proceeds to step S16. When execution of the registration correction processing is earlier in the history, the process proceeds to step S15. In step S15, the correcting section 86 executes the registration correction processing. In step S16, the correcting section 86 executes the halftone correction processing. In step S18, the history of execution of the correction processings is stored in the memory portion 71.

In a case where it is necessary to execute all of the three correction processings even though the sufficient time for performing all the correction processings cannot be secured, it is preferable to inform the user by displaying on a display section provided in the operation panel of the image forming apparatus that immediate output is impossible since the correction processings are being executed. That is, it is preferable that the selection section 87 informs, in a case of selecting both of the halftone correction processing and the registration correction processing, that both of the halftone correction processing and the registration correction processing are to be executed.

In a case where a long time has been passed from the latest execution date to the present time in the history or in a case where a large change has occurred inside the apparatus due to repair, replacement, or the like, it is preferable to execute all the correction processings even when the sufficient time cannot be secured.

Further, as another mode of embodiment, it is possible to provide an image forming program for causing a computer to execute the above-described image forming method and a computer-readable recording medium on which the image forming program is recorded.

As the recording medium, a memory for causing processings to be executed in a CPU, such as a RAM or ROM (Read Only Memory) itself, may be used, or a recording medium readable as being inserted into a program reading device provided in the computer as an external memory device may be used. In any case, the recorded image forming program may be executed when the CPU accesses to the recording medium or may be executed by downloading the image forming program read out from the recording medium by the CPU in a program memory area. The program for downloading has previously been stored in the predetermined memory device. The CPU controls portions of the computer in an integrated manner in order to cause the computer to perform the predetermined image formation in accordance with the installed image forming program.

Also, as a recording medium readable by the program reading device, a medium recording the program in a fixed manner, i.e. a tape such as a magnetic tape and a cassette tape; a disc such as a magnetic disc including a flexible disc, a hard disc, and the like or an optical disc including a CD-ROM (Compact Disc-Read Only Memory), an MO (Magneto Optical Disc), an MD (Mini Disc), a DVD (Digital Versatile Disc), and the like; a card such as an IC (Integrated Circuit) card (including a memory card) and an optical card; or a semiconductor memory such as a mask ROM, an EPROM (Erasable Programmable Read Only Memory), an EEPROM (Electrically Erasable Programmable Read Only Memory), and a flush ROM may be used.

Also, a medium carrying the program on demand, such as those obtained by causing the computer to access a communication network including the internet and downloading the image forming program from the communication network may be used. In the case of downloading the image forming program from the communication network, the download program has previously been stored or installed from another recording medium in the computer.

One example of a computer system for executing the image forming program read out from the recording medium is a system formed of an image reading device such as a flat bed scanner, a film scanner, and a digital camera, a computer performing various processings including the above-described image forming method by executing various programs, an image display device for displaying a processing result of the computer, such as a CRT (Cathode Ray Tube) display and a liquid crystal display, and an image output device for outputting the processing result of the computer on a paper sheet, such as a printer, that are connected to each other. The computer system is provided with a modem for accessing a server or the like via a communication network to send and receive various programs including the image forming program and various data such as image data.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus forming an image using electrophotography, comprising:

an image forming section having a photoreceptor having on its surface a photosensitive film for forming an electrostatic latent image and a developing section for forming a toner image by supplying a toner onto the electrostatic latent image on the photoreceptor surface;

a correcting section executing a plurality of correction processings for performing image quality adjustment of an outputted image of the image forming section, a history storage section for storing a history of execution of the plurality of correction processings; and a selection section selecting the correction processing to be executed from the plurality of the correction processings based on the history, wherein the plurality of correction processings comprises a high density correction processing as an essential processing, and a halftone correction processing and a registration correction processing as optional processings, and wherein the selection section refers to a history of the halftone correction processing and the registration correction processing and selects from the halftone correction processing and the registration correction processing the one whose latest execution is earlier than that of the other.

2. The image forming apparatus of claim 1, wherein the high density correction processing is executed at a toner density of about 1.35 measured by a Macbeth density meter.

3. The image forming apparatus of claim 1, wherein the selection section informs a user, in a case of selecting both of the halftone correction processing and the registration correction processing, that both of the halftone correction processing and the registration correction processing are to be executed.

4. The image forming apparatus of claim 1, wherein the image quality adjustment is executed when the apparatus is started up, when the cumulative number of printed copies reaches to a predetermined value, or when a toner consumption amount by a pixel count reaches a predetermined value.

5. The image forming apparatus of claim 1, wherein the image forming apparatus is a tandem color image forming apparatus.

6. An image forming method of forming an image using electrophotography, comprising:

storing a history of execution of a plurality of correction processings for performing image quality adjustment of an outputted image of an image forming section comprising a developing section for forming a toner image by supplying a toner to an electrostatic latent image on a photoreceptor surface, the image quality adjustment of the outputted image being caused by the plurality of correction processings, wherein the plurality of correction processings comprises a high density correction processing as an essential processing, and a halftone correction processing and a registration correction processing as optional processings, and providing a selection section for selecting the correction processing to be executed from the plurality of correction processings based on the history, wherein the selection section refers to a history of the halftone correction processing and the registration correction processing, and the one whose latest execution is earlier than that of the other is selected from the halftone correction processing and the registration correction processing.

7. A non-transitory computer-readable recording medium on which an image processing program for causing a computer to execute the image forming method of claim 6 is recorded.

* * * * *